US005146209A

United States Patent [19]

Beghelli

[11] Patent Number: 5,146,209

[45] Date of Patent: Sep. 8, 1992

[54] SELF-CONTAINED APPARATUS FOR EMERGENCY LIGHTING INCORPORATING ALARM SYSTEMS FOR FIRE, GAS AND THE LIKE

[75] Inventor: Gian P. Beghelli, Monteveglio, Italy

[73] Assignee: G.P.B. Beghelli S.R.L., Monteveglio, Italy

[21] Appl. No.: 664,590

[22] Filed: Mar. 5, 1991

[30] Foreign Application Priority Data

Nov. 5, 1990 [IT] Italy ..... 4935/90[U]

[51] Int. Cl.[5] ..... G08B 17/10

[52] U.S. Cl. ..... 340/693; 340/628; 340/632; 340/691

[58] Field of Search ..... 340/693, 691, 628, 632, 340/586, 584, 577, 521

[56] References Cited

U.S. PATENT DOCUMENTS

| | | | |
|---|---|---|---|
| 4,263,588 | 4/1981 | Gautier | 340/693 |
| 4,959,637 | 9/1990 | Woods et al. | 340/693 |
| 5,028,911 | 7/1991 | Wanat et al. | 340/693 |

*Primary Examiner*—Glen R. Swann, III
*Attorney, Agent, or Firm*—Herbert Dubno

[57] ABSTRACT

A self-contained apparatus for emergency lighting has a light, a detector for gas or the like, which can produce an electric input, and a processor which can receive the electric input and produce an optic and/or acoustic alarm.

13 Claims, 2 Drawing Sheets

SELF-CONTAINED APPARATUS FOR EMERGENCY LIGHTING INCORPORATING ALARM SYSTEMS FOR FIRE, GAS AND THE LIKE

FIELD OF THE INVENTION

My present invention relates to a self-contained apparatus for emergency lighting comprising at least one sensor/detector sending an electric input to a processor, and a detection and alarm system controlled by the processor.

BACKGROUND OF THE INVENTION

It is known that, in case of electric current cutoff and/or gas escape or fire, a timely alarm signal is required to allow prompt aid, intervention and/or danger neutralization.

In the state of the art, several systems for the detection of such events are known, however, they possess some significant limitations. For example, they need to be constantly connected to the supply mains. As to portable lamps, it is usually impossible to incorporate gas detectors or the like therein.

OBJECT OF THE INVENTION

The object of the present invention is to provide a self-contained lighting apparatus suitable for the detection and alarm signalling of dangerous events such as gas escapes, fires and the like, which can arise in the vicinity of a lighting apparatus.

SUMMARY OF THE INVENTION

In the present invention a self-contained apparatus for emergency lighting comprises lighting means, detection means for gas, smoke, heat and the like, which send the electrical input, and alarm means which can be activated by the processing means, so that dangerous events can be detected and signalled in real time and without any need of supply means.

More particularly, the portable emergency lighting and alarm apparatus of the invention comprises:

a portable housing;

a rechargeable battery in the housing provided with means connectable to an electrical supply source for recharging the battery from the source, the apparatus being disconnected from the source for portable use;

a lamp in the housing connectable with the battery and provided with circuit means for illuminating the lamp upon failure of the supply and disconnection of the apparatus therefrom;

at least one sensor on the housing responsive to an emergency situation in a vicinity of the housing and producing an output;

processing means for responding to the output; and alarm means connected to the processing means for generating an alert signal in response to the output.

The sensor can be a gas detector, a smoke detector, a heat detector or a flame detector and the alarm means can include an acoustic and/or optical output. The housing can be provided with a plurality of such detectors and a corresponding number of processors connected to the detectors.

The processor can be connected by wires with the alarm means or with an electromagnetic wave transmitter and an encoder while the alarm means can be provided with an electromagnetic receiver and a decoder. The alarm means can include means for illuminating the lamp, e.g. by causing the lamp to blink, so that the emergency lighting source also forms the alarm means. Where a switch is provided for turning the lamp on or off, the alarm means activates the lamp independently of a position of the switch means.

BRIEF DESCRIPTION OF THE DRAWING

Further characteristics of the present invention will be better disclosed from the following detailed description of an embodiment of the invention, with reference to the drawing, in which.

DESCRIPTION

Figure 1:
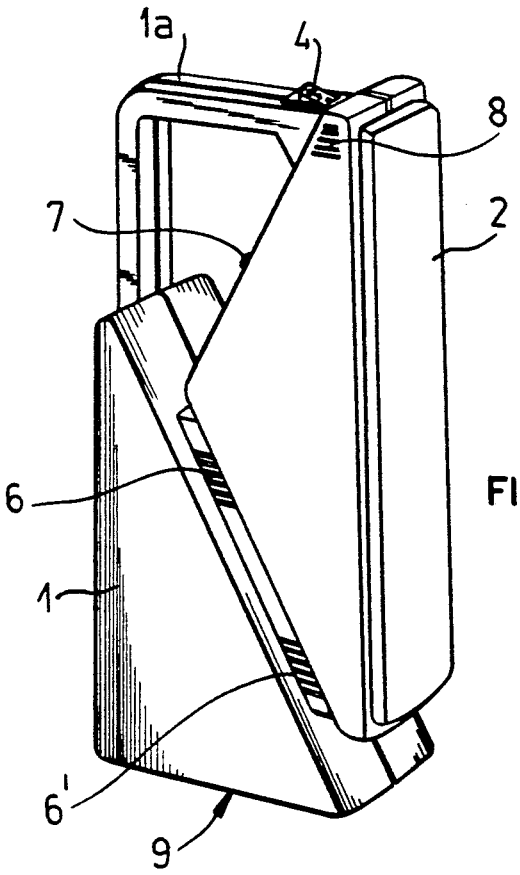
FIG. 1 is a side perspective view which illustrates an apparatus according to the present invention.
Figure 2:
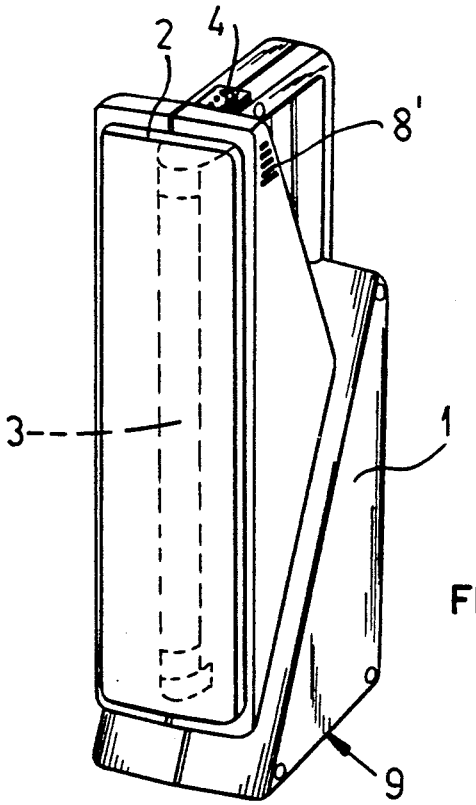
FIG. 2 is a front perspective view of the portable lamp shown in FIG. 1.
Figure 3:
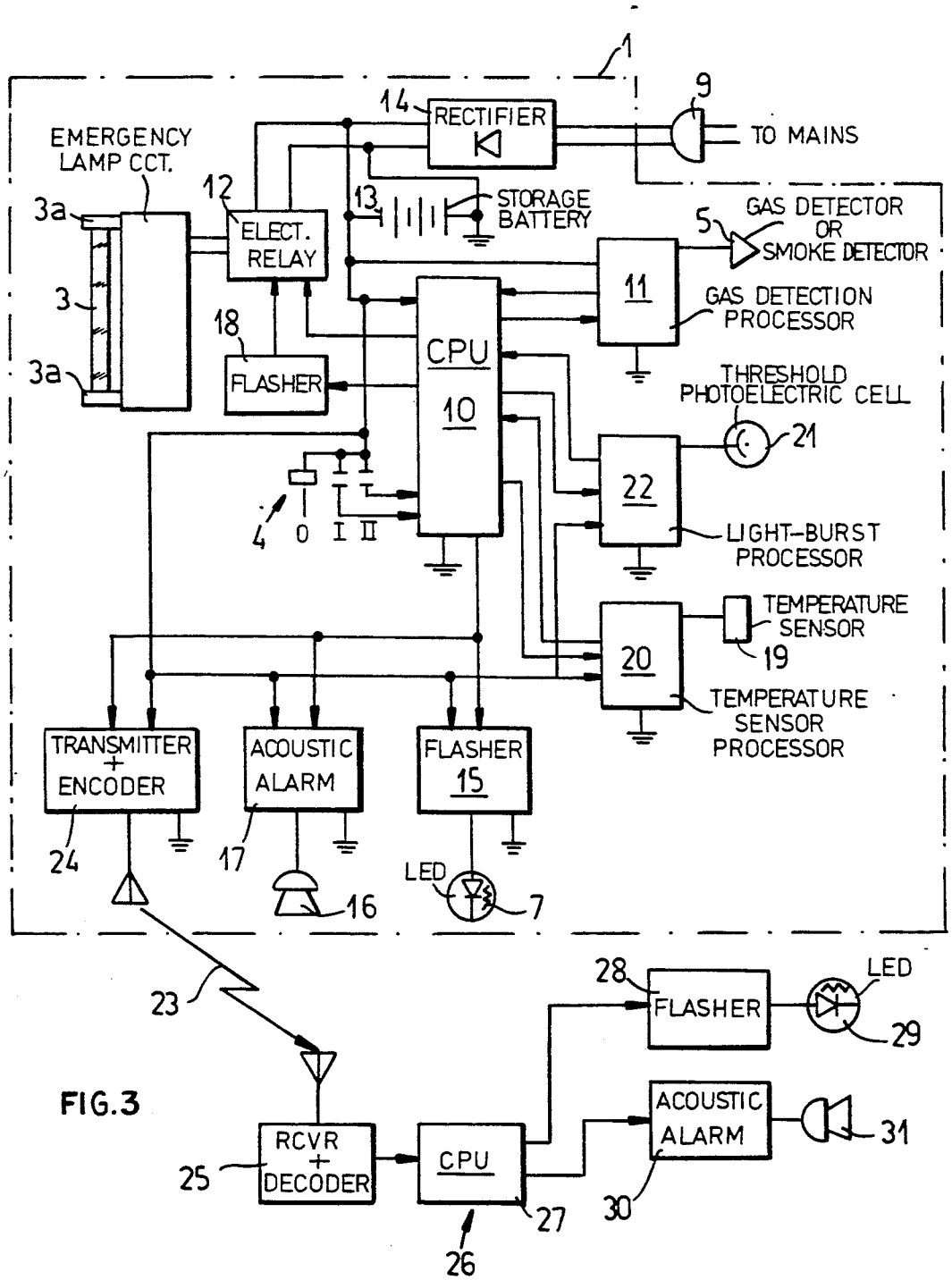
FIG. 3 is a block circuit diagram of the system of the invention.

In body 1, provided with a handle 1*a*, a transparent screen 2 is inserted in the forepart. A lighting element 3, supported by its caps 3*a*, is positioned under the screen. On the handle, switch 4, controlling the control processing unit 10, which can be a programmed microprocessor or so-called microcomputer, can be changed over with three positions. With plug 9 connected to the supply mains and power available in the supply mains, in position II, only gas detector 5, communicating with the surrounding space through the louvers 6 and 6', is turned on through its processor 11. In position I also the emergency lamp 3, in case of current cutoff, is turned on by the CPU 10 through the electronic relay 12.

When plug 9 is disconnected from the supply, (making the unit a self-contained portable lamp), with the switch on "O" position, the system is completely off. In the "I" position, both gas detector and emergency lamp are on. In the "II" position only the gas detector is activated. Therefore, if the device is disconnected from the supply while the switch is in position "I," the lamp will be automatically actuated. In the absence of external power, the storage battery 13, normally charged through the rectifier 14 supplies the power. In a dangerous situation due to gas emission, the alarm consists of LED 7 blinking under the control of a flasher 15 and in the intermittent operation of an acoustic signal by the sound generator 16 and its driver 17, the sound signal emerging from louvers 8–8'.

After a predetermined time, lamp 3 flashes as well, controlled by the flasher 18, while the acoustic signal continues.

In practice, the present invention can have various features, especially with respect to the details of the circuit and as to the detector and processor configurations. Particularly, the detector 5 utilized in the apparatus of the present invention can be sensitive to the gas resulting from the combustion of either organic or inorganic substances (for instance an oxygen detector set at the oxygen concentration value indicating a progressing combustion or a smoke detector. Alternatively, it can be replaced by or used in combination with a temperature sensor 19 and an appropriate processor 20 therefor (for instance, an infrared ray absorption detector). Again it can be replaced by or used together with a threshold photoelectric cell (P.E.C.) 21 and a processor 22, detecting the sudden bright light resulting from a fire or flame.

A first mode of the apparatus of the present invention is provided with a detector 5, 19 or 21 of the abovementioned type, incorporated in the emergency lamp and connected to the processor 11, 20 or 22 which processes the signals sent from the detector so that a first input to the CPU 10 signals fire absence and a second input to CPU 10 signals fire presence. The CPU 10 sends a first output to the alarm system disabling it to function when the processor receives the first input, and a second output to the alarm system enabling it to function, when the processor receives the second input. Each processor can be connected only to one sensor.

This apparatus is provided with the same number of processors and sensors, with one processor connected to each sensor.

Generally, the connection with the alarm system is obtained through electric wires.

However, in another mode, the connection is made by means of electromagnetic waves (e.g. radiowaves as shown as 23), so that the processors are provided with a transmitter and encoder 24, and the alarm system 26 is provided with a receiver and decoder 25. The remote alarm system 26 is here shown to use a CPU 27 controlling a flasher 28 and an LED 29, as described above with reference to the flasher 15 and the LED 7, and an acoustic alarm 30, 31.

Of course, the apparatus can be provided with two or more detectors at the same time, all incorporated in the same emergency lamp.

In the system, dangerous events can be detector and signalled in real time and without any need of an external electric supply. The optic alarm system, blinking and fixed, is obtained in part by using the main light source of the emergency lamp (fluorescent or incandescent lamp).

The incorporated processor activates a fixed acoustic and optic alarm system, preventing the fixed optic alarm system (lamp) from being switched on or off, independently from switch control. The emergency lamp, gas detector, optic and acoustic alarm system are all operated by an incorporated rechargeable battery autonomously from the electric supply. The detector can be externally connected to the lamp body, in a fixed or permanent way, by means of electric wires as desired.

I claim:

1. A portable emergency lighting and alarm apparatus, comprising:

a portable housing;

a rechargeable battery in said housing provided with means connectable to an electrical supply source for recharging said battery from said source, said apparatus being disconnected from said source for portable use;

a lamp in said housing connectable with said battery and provided with circuit means for illuminating said lamp upon failure of said supply and disconnection of said apparatus therefrom for said portable use;

at least one sensor on said housing responsive to an emergency situation in a vicinity of said housing and producing an output;

processing means for responding to said output; and alarm means connected to said processing means for generating an alert signal in response to said output.

2. The apparatus defined in claim 1 wherein said sensor is a gas detector.

3. The apparatus defined in claim 1 wherein said sensor is a smoke detector.

4. The apparatus defined in claim 1 wherein said sensor is a heat detector.

5. The apparatus defined in claim 1 wherein said sensor is a flame detector.

6. The apparatus defined in claim 1 wherein said alarm means includes an acoustic output.

7. The apparatus defined in claim 1 wherein said alarm means includes an optical output.

8. The apparatus defined in claim 1 wherein said housing is provided with a plurality of said sensors and a corresponding number of processors connected to said detectors.

9. The apparatus defined in claim 1 wherein said processing means is connected by electric wires with said alarm means.

10. The apparatus defined in claim 1 wherein said processing means is provided with an electromagnetic-wave transmitter and an encoder and said alarm means is provided with an electromagnetic wave receiver and a decoder, said processing means being connected to said alarm means by electromagnetic waves propagated between said transmitter and said receiver.

11. The apparatus defined in claim 1 wherein said alarm means includes means for illuminating said lamp.

12. The apparatus defined in claim 11 wherein said means for illuminating said lamp includes means for causing said lamp to blink.

13. The apparatus defined in claim 1, further comprising switch means for turning said lamp on and off, and means connected to said alarm means for activating said lamp independently of a position of said switch means.

* * * * *